US005318201A

United States Patent [19]

Lowe et al.

[11] Patent Number: 5,318,201

[45] Date of Patent: Jun. 7, 1994

[54] APPARATUS FOR AGITATING CIGARETTE FILTERS IN A FILTER HOPPER

[75] Inventors: Byron L. Lowe; Robert L. Grizzard, both of Macon, Ga.

[73] Assignee: Brown & Williamson Tobacco Corporation, Louisville, Ky.

[21] Appl. No.: 47,710

[22] Filed: Apr. 14, 1993

[51] Int. Cl.[5] ..... B65G 59/00

[52] U.S. Cl. ..... 221/200; 221/266; 221/258; 221/281; 131/282; 198/533; 198/454; 198/347.2

[58] Field of Search ..... 131/282, 283; 198/533, 198/453, 454, 347.2, 347.1; 221/200, 204, 277, 266, 281, 278, 19, 10, 258

[56] References Cited

U.S. PATENT DOCUMENTS

| | | | |
|---|---|---|---|
| 2,902,186 | 9/1959 | Pollmann | 221/10 |
| 3,081,778 | 3/1963 | Dearsley . | |
| 3,165,953 | 7/1962 | Brown et al. . | |
| 3,305,128 | 1/1966 | Dearsley . | |
| 3,308,833 | 5/1955 | Dearsley . | |
| 3,485,208 | 12/1989 | Hemming et al. . | |
| 3,789,744 | 2/1974 | Wahle . | |
| 3,858,708 | 1/1975 | Hollerton et al. | 198/347.1 |
| 4,063,633 | 12/1977 | Hall . | |
| 4,069,930 | 1/1978 | Atwell et al. . | |
| 4,084,685 | 4/1978 | Hollenton et al. . | |
| 4,321,050 | 3/1982 | Oesterling . | |
| 4,420,073 | 12/1983 | Hausler et al. . | |
| 4,498,488 | 2/1985 | Johnson . | |
| 4,763,775 | 8/1988 | Jefferys et al. . | |
| 4,785,928 | 11/1988 | Hinchcliffe et al. | 131/282 |
| 4,795,019 | 1/1989 | Spada et al. . | |
| 4,813,527 | 3/1989 | Carter . | |
| 5,220,992 | 6/1993 | Milins | 131/282 |

FOREIGN PATENT DOCUMENTS

| | | | |
|---|---|---|---|
| 955755 | 1/1957 | Fed. Rep. of Germany | 131/282 |

*Primary Examiner*—H. Grant Skaggs
*Attorney, Agent, or Firm*—Charles I. Sherman

[57] ABSTRACT

An apparatus for agitating filters in a feed hopper from which the filters are fed pneumatically to a filter attaching machine. The hopper drive apparatus includes an independent drive and speed reducer mechanism that drives the filter agitators as long as the filter attaching machine receives filters. The agitation system uses a stand alone independent drive system that uses a timing belt to drive the agitators. This agitation system provides a means for operating with fragile, segmented charcoal filters in that the filters are permitted to move up and down more freely than with conventional agitation devices, allowing more room for incoming filters from the receiver and reducing damage to the filters and jamming of the filters in the transfer system.

7 Claims, 4 Drawing Sheets

APPARATUS FOR AGITATING CIGARETTE FILTERS IN A FILTER HOPPER

BACKGROUND OF THE INVENTION

This invention relates to the feeding of cigarette filters comprised of fiber, charcoal, or various combinations thereof to a cigarette making machine. More particularly this invention relates to the feeding of fragile filter elements such as charcoal filters to a cigarette making machine. Even more particularly this invention relates to the agitation of a cigarette filter hopper in the feeding of charcoal filters to a cigarette making machine.

The cigarette manufacturing industry utilizes automated machines to interconnect cigarette filter rods with tobacco rods. One method of joining the cigarette rods to the filters is by using a filter tip attachment machine by aligning the distal ends of a single filter rod with a pair of tobacco rods, wrapping the joint with tipping paper, and cutting the filter in the center forming two cigarettes.

In the manufacture of filter tip cigarettes prior to the feeding of filter rods into a filter tip attachment machine, a filter hopper is provided to store cigarette filters and is a source of supply for the filters when the filter attaching machine is operating. Moreover, in order to maintain a uniform supply of these filters into the feed end of a filter attachment machine, bins have been provided to maintain the agitation of the cigarette filters in the feed hopper so that uniformity of feed to the filter attaching machine is maintained. For example, U.S. Pat. Nos. 3,081,778 and 3,308,833 teach the use of an oscillating agitating flap mounted within the feed hopper which prevents the weight of the bulk of filters in the hopper to press on the region where the filters are discharged and also tends to break up the bridging of the filters over the discharge. U.S. Pat. No. 4,069,930 teaches a feed hopper including an agitator translatable in the hopper; and U.S. Pat. No. 4,063,633 teaches an agitator disposed within the hopper which is mounted to rotate or oscillate in order to break up clumps of rods which may form in the hopper.

Moreover, it has been known to employ a cam mechanism to the frame of a feed hopper or directly to the feed hopper wherein the cam oscillates the hopper in response to the operation of the mechanism for discharging the filter rods from the filter hopper.

Because of variations in the rate of production, the filter feed conveying equipment and hopper agitating equipment is routinely stopped and started for various reasons, such as when the quantity of filters exceeds a predetermined amount in the hopper due to a faster rate of supply than demand with the filter attachment machine. Since the supply of filter rods may be from a conveyor mechanism located several feet from the filter attachment machine, the number of rods in transit at any instant may be considerable. Thus, where the supply unit is stopped in response to a command from the filter tip attachment machine all of the filter rods in transit will continue to be delivered to the hopper which has been stopped from delivery of filters to the attachment machine.

Typically, these devices are adequate for feeding cigarette filters including a porous fiber filter element attached to the cigarette such as shown and described in U.S. Pat. No. 4,498,488. However, carbon filled cigarette filters generally tend to be heavier, yet more fragile than porous fiber filter elements. Because charcoal filters are made in segments they tend to break when fed using conventional hopper feeding apparatus.

When charcoal filters are fed to the hopper via a pneumatic conveyor system after the agitator and hopper feed mechanism have been turned off due to a problem with the cigarette attachment machine, the charcoal filters will tear because of the extra pressure of the heavier "charcoal" filters already in the hopper. Also, the filter wrap for charcoal have a much higher friction ratio than standard filter wrap. Because the charcoal filters are made in segments the filters tend to tear and break during the feed process to conventional hopper filter dispensing system, when the filter attachment machine stops running because the conventional agitator systems are designed to stop running at the same time the filters are still being fed to the hopper through the pneumatic conveying system. Furthermore, when the agitator is not running the excessive weight from the charcoal filters cause the filters to lock up and jam the hopper instead of sliding across each other. Thus, the existing operation of conventional agitators presents a problem when feeding charcoal filters pneumatically.

The filter vibratory devices described in the aforementioned references are designed to utilize existing gear drive means and to run only in the event the filter attachment machine is running in order not to overfill the cigarette filter hopper. These agitating devices perform adequately using standard light weight, one piece, fibrous cigarette filters. However, pneumatic feeding of fragile, heavier, segmented charcoal filters by these aforementioned devices presents a problem in that the agitators tend to damage and tear apart the carbon filled filter elements resulting in jamming of the hopper feed mechanism, lost time, increased maintenance, and damaged material.

The present invention solves the problems associated with the agitation of fragile filters by providing a novel means to maintain a consistent flow of carbon filled filters through the feed hopper to the filter attachment machine regardless of the density or material of construction of the filter elements. The system allows the filter elements to move up and down and side to side within the hopper more freely without binding and allows more room for the incoming filters from the receiver. Moreover, the present invention utilizes a means to agitate the filter elements even when the filter attachment machine is not operating, but is still receiving filters from the pneumatic filter conveyors.

SUMMARY OF THE INVENTION

The present invention provides an apparatus for delivery of cigarette filter rods from a feed hopper holding the rods to a discharge means from the feed hopper. The present invention further provides the feed hopper apparatus for feeding fragile, segmented charcoal type filters from a feed hopper into a filter attaching machine.

The present invention even further provides means for agitating a cigarette filter hopper wherein the hopper is agitated in response to the operation of the means for feeding filters into the hopper. The present invention further allows the agitator to continue running after the hopper filter attachment machine feed has been stopped, until the hopper is full, until the hopper feed conveyor is empty, or after a predetermined programmed period of delay. By agitating the filters in the hopper, additional usable space is generated in the hopper. The agitation of the filters in the hopper prior to feeding also prevents jamming of the filters together causing damage to the filters resulting in jamming of the cigarette attachment machine feed mechanism.

Furthermore, a buffer system consists of a conveyor system wherein filters are stacked in the filter hopper above the receiver where the filters are being pneumatically fed to the hopper. The height of the buffer determines how long the filter attachment machine can run without running out of filters if the filter making machine stops running. The present invention utilizing an active agitator enables the buffer height to be higher to give the normal extra run time on the filter attachment machine if the filter making machine stops running.

The present invention provides an apparatus for agitating cigarette filters in a filter hopper comprising a filter hopper having a feed inlet and a feed outlet, means to feed filters to the feed inlet, means to discharge filters through the feed outlet, and means to agitate the feed hopper in response to the means to feed filters to the hopper.

More particularly, the present invention provides a means to agitate filters, such as charcoal filters, when used in conjunction with feeding filters pneumatically to a filter attachment machine. The hopper drive apparatus consists of an independent drive and speed reducer system that activates the filter agitators and continues to operate independent of operation of the filter attachment machine until the receiver stops feeding filters to the feed hopper. The present invention replaces the conventional gear driven system which is operable in response to start-up and shut-down of the filter attachment machines. The vibratory apparatus motor of the present invention operates independent of the filter attachment machine and the drive motor of the present invention is electrically responsive to a signal from a control panel which controls the motors for the filter receivers, so that whenever the pneumatic feed system for the filter hopper and the filter receivers are conveying filters into the hopper, the agitator is activated regardless of whether the filter attachment machine is running or not running.

Further features and advantages of the present invention will become more apparent from the following description taken in conjunction with the accompanying drawings which illustrate, by way of example, the principles in the invention.

BRIEF DESCRIPTION OF THE DRAWINGS

For a better understanding of the nature and objects of the present invention, reference should be made to the following detailed description and the accompanying drawings, in which.

DETAILED DESCRIPTION OF THE PREFERRED EMBODIMENT

Figure 1:
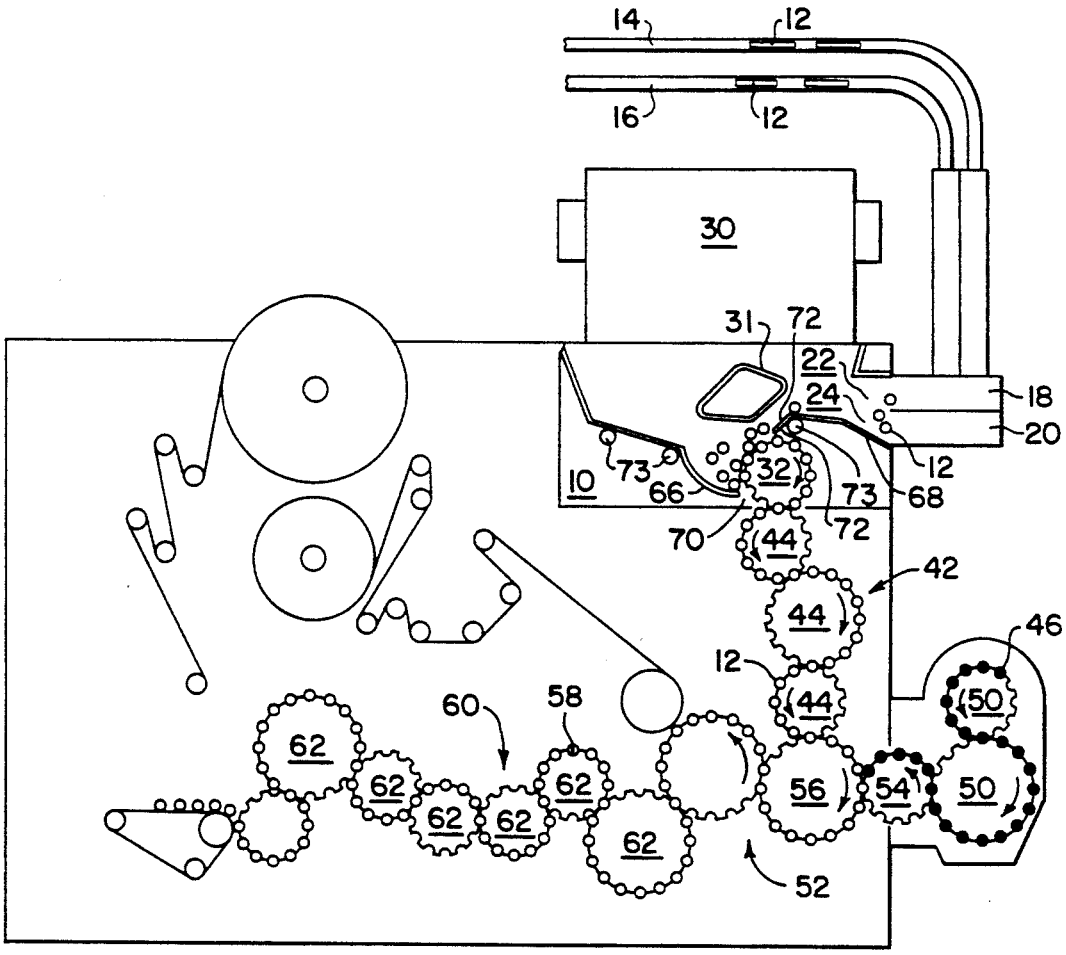
FIG. 1 is a side elevation, partly in section, showing the components parts of the filter feed hopper feed mechanism in flow communication with the tobacco rod feed system and filter attachment apparatus of the present invention.
Figure 2:
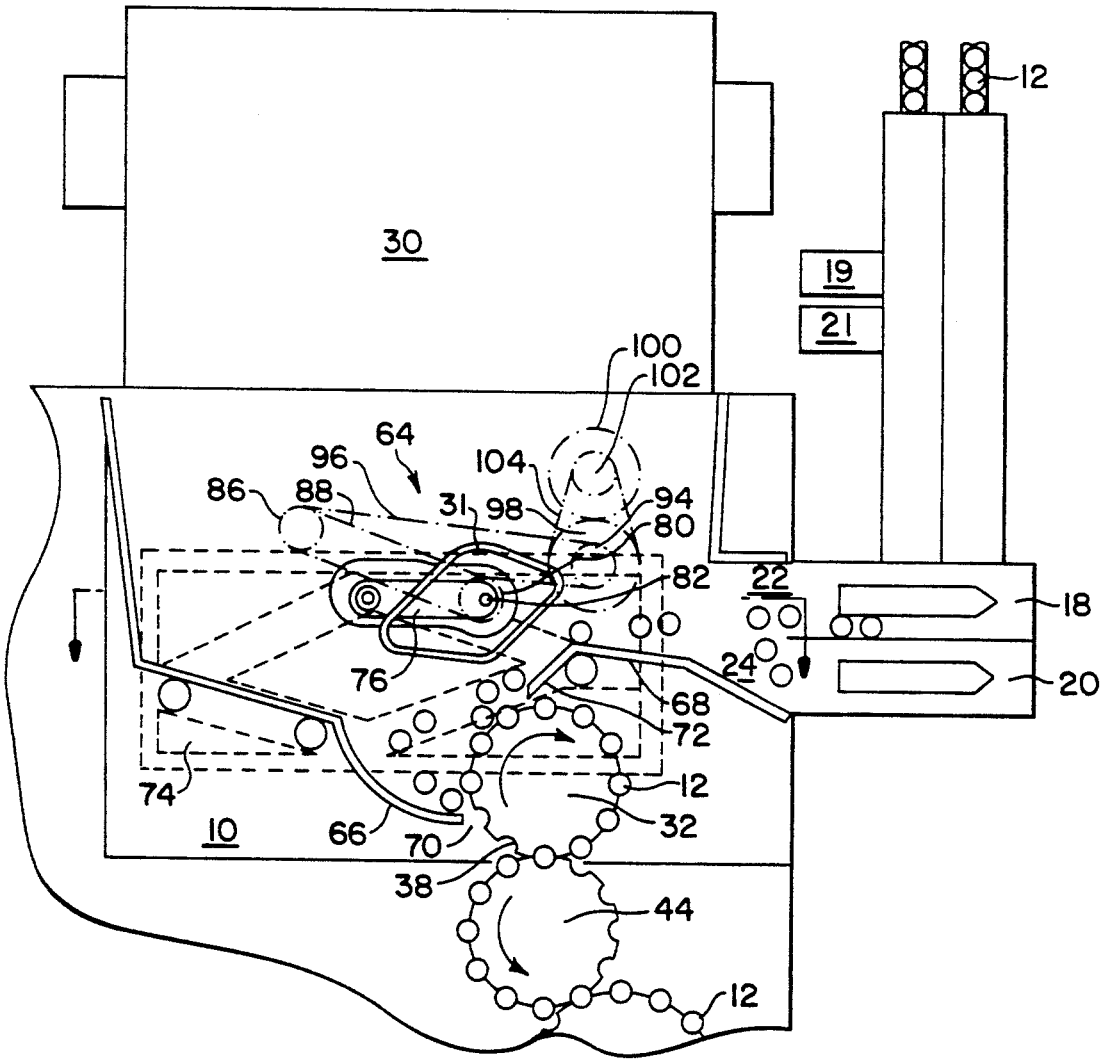
FIG. 2 is a plan side view of the hopper filter receiving system, the hopper filter feeding mechanism, and the hopper agitation mechanism of the present invention.

FIGS. 1 and 2 show the feed hopper 10 of the present invention and a means for feeding cylindrical rod type cigarette filters 12 therein comprised of charcoal and/or fibrous material into the feed hopper 10. The filters 12 utilized in the preferred embodiment are of the segmented charcoal type selected to show the advantages of the present invention. In the preferred embodiment, filters 12 are pneumatically conveyed from a pair of overhead conveyor systems or buffers 14, 16 downwardly to a pair of pneumatic filter rod receivers 18 and 20 actuated by receiver motors 19 and 21, respectively. The filters 12 are conveyed through hopper feed inlets 22 and 24 through the receivers 18 and 20, then through a pair of receiver accelerating rollers (not shown) which are apart from one another and used for feeding the filters 12 into the hopper 10 individually to prevent damage to the filters 12 and jamming of the filters 12 in the hopper 10 feed mechanism. The filters 12 extend transversely with respect to the sides of the hopper 10 so that the ends of the filters 16 contact the walls of the hopper 10. A magazine or plug tray 30 is mounted onto the top of the hopper 10 to accommodate hopper overflow of filters 12. A generally pyramid or diamond shaped baffle 31 is secured to the sides of the hopper 10 and centrally located between the ends of the hopper 10, and the bottom of the plug tray 30 to prevent bridging of the filters 12 flowing downward into the hopper 10 from the plug tray 30.

The filters 12 converge downwardly from the top sides of the hopper 10 feeding the filter rods 12 in succession around and over a first grooved filter receiving feed roll 32 positioned at the discharge outlet 40 at the bottom of the hopper 10 which is in flow communication with a feed mechanism 42 for a filter attaching means. A pair of compression rollers (not shown) may be mounted spaced apart from the feed roll 32 in order to urge the individual filters 12 into the grooves 38 of the grooved filter receiving feed roll 32. The filter feed mechanism 42 comprises a plurality of grooved filter rollers 44 in spaced apart vertical relationship so that the filters 12 are transferred by gravity from one grooved roller 44 to an adjacent grooved roller 44.

As shown in FIG. 1, tobacco rods 46 are conveyed to a filter attachment means through a tobacco rod transfer system 48 comprising a series of spaced apart grooved rollers 50. The filter rods 12 are joined with the tobacco rods 46 by a filter attachment machine or mechanism 52 wherein a tobacco rod roller 54 and filter rod roller 56 mesh in a cooperative relationship to join the tobacco rod 46 to a filter rod 12 forming a cigarette 58. A cigarette transfer system 60 utilizes a plurality of spaced apart grooved rollers 62 to transfer the cigarettes 58 for further processing.

In order to maintain an orderly and consistent flow of filters 12 to the grooved feed roll 32, the feed hopper 10 is vibrated or agitated in response to an agitation means 64 as shown in FIGS. 1 and 2. The agitation means 64 comprises a first vibratory baffle plate 66 and a second vibratory baffle plate 68. The first vibratory baffle plate 66 comprises a generally flat strip of material extending downwardly at an angle from the top of one side of the hopper 10 toward the center of the hopper 10, wherein the distal end 70 of the first baffle plate 66 is positioned slightly below the centerline, adjacent to, and spaced apart from the grooved roll 32 a distance less than the width of a filter 12. A second vibratory baffle plate 68 comprises a generally flat strip of material extending downwardly at an angle from the top of the opposite side of the hopper 10 toward the center of the hopper 10, wherein the distal end 72 of the second baffle plate 66 is positioned slightly above the centerline, adjacent to, and spaced from the grooved roll 32 a distance less than the width of a filter 12. Rotation of the grooved roll 3 toward the distal end 72 of the second plate 68 urges individual filters 12 into the grooves 38 of the grooved roller 32. Each one of the baffle plates 66 and 68 are removably mounted to an oscillating frame 74 movably secured within the hopper 10.

FIG. 2 shows a cutaway side view of the hopper filter receiving mechanism, the hopper filter feeding mechanism, and the hopper agitation mechanism comprising vibratory plates 66 and 68 attached to the vibratory frame 74 and the attachment of a crank arm 76 driven by an independent external power source. As shown in phantom lines, the generally rectangular vibratory frame 74 is generally trapezoidal in shape. The vibratory frame 74 is movably secured within the hopper 10 by mounting means such as pins 73 which extend outwardly from the sides of the vibratory frame 74 through grooves or slots formed at a selected position within the sides of the hopper 10. Oscillation of the vibratory frame 74 vibrates the first and second vibratory plates 66 and 68, respectively, either up and down, from back and forth, or by a combination of vibratory motions when in a vibratory mode.

Figure 3:
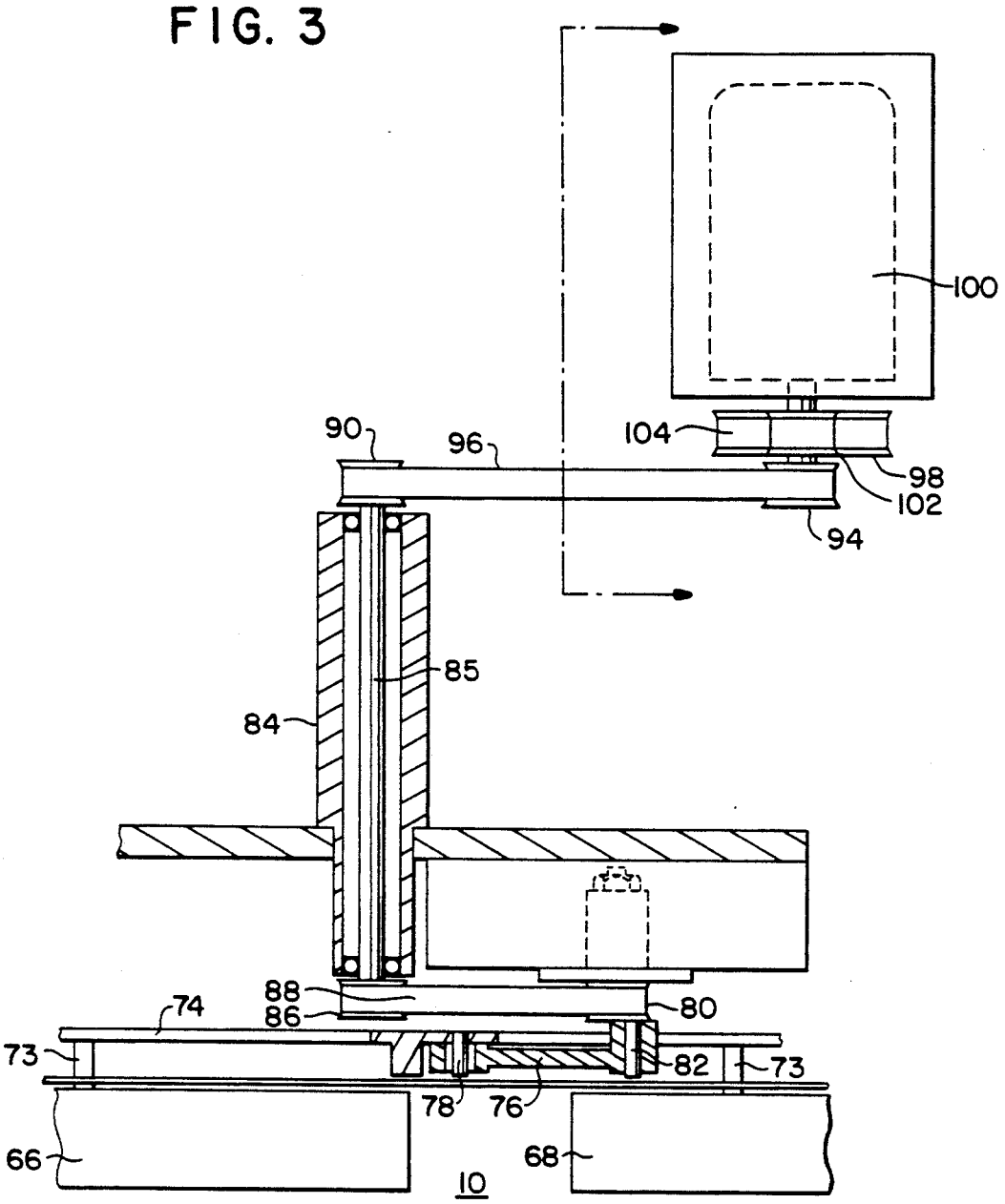
FIG. 3 is a top view of the hopper, drive train, and crank arm assembly and cam mechanism associated with the vibratory filter agitation device of the present invention.

FIGS. 2 and 3 show the hopper 10, drive train assembly, and cam mechanism associated with the vibratory filter agitation device. A vibratory frame 74 is mounted within the hopper 10 by a plurality of pins 73 extending through the wall of the hopper 10 supporting the vibratory frame 74 in a moveable manner. The vibratory frame 74 is connected to a drive means by a crank arm 76 located on the exterior of the hopper 10. A portion of the vibratory frame 74 within the hopper 10 is connected to an exterior crank arm 76 by a bell pin 78. The other end of the crank arm 76 is connected to a tooth timing belt pulley 80 having an eccentric pin 82 mounted offset from the center of the pulley 80 to form a cam mechanism.

Figure 4:
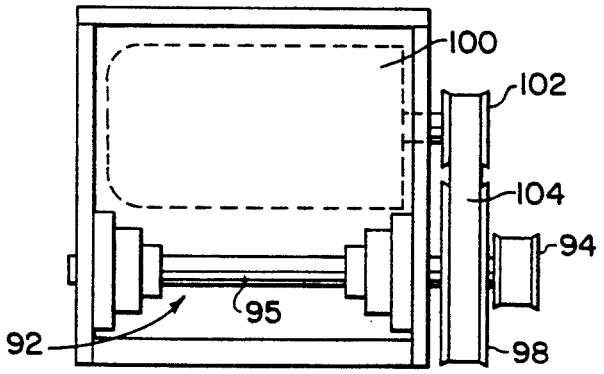
FIG. 4 is a side view showing a drive motor and a speed reducer device for the vibratory filter agitation apparatus of the present invention.

A first variable rate transmission or speed reducer 84 includes a shaft 85 therethrough extending outwardly on each side thereof, with a first seventy-two tooth pulley 86 being on the end of one shaft and a second twenty tooth pulley 90 being on the end of the opposite shaft. The timing belt pulley 80 with the eccentric pin 82 is connected to the first seventy-two tooth pulley 86 of the speed reducer 84 by a timing belt 88. The second speed reducer pulley 90 is connected to a second variable rate transmission or speed reducer 92 mounted within the same housing as the drive motor 100 as shown in FIG. 4. The second speed reducer 92 comprises a shaft 95 extending through the housing outwardly on one side thereof. The shaft 95 has an outer twenty tooth pulley 94 and an inner seventy-two tooth pulley 98 mounted thereon. The first pulley 94 is connected to the second speed reducer pulley 90 by a drive belt 96. The second speed reducer pulley 98 is connected to a twenty-four tooth pulley 102 on the vibratory drive motor 100 by a timing belt 104. The vibratory motor 100 drives the second speed reducer 92 which drives the first speed reducer 84 which drives the cam mechanism of the agitator or vibratory frame 74.

The agitator or vibratory motor 100 is actuated in response to the receiver drive motors 19 and 2 of the receivers 18 and 20 which pneumatically feed filters 12 into the feed hopper 10. The operation of the motor 100 drives the eccentric pulley 80 at a preselected rate so that rotational motion transferred from the eccentric pin 82 to the crank arm 76 moves the vibratory plates 66 and 68 in the hopper 10 at a desired rate of agitation. When the pneumatic conveying system or receivers motors 19 and 21 are not operating to feed filters 12 to the hopper 10, the vibratory motor 100 is automatically deactivated and agitation of the filters 12 in the feed hopper 10 is discontinued.

Figure 5:
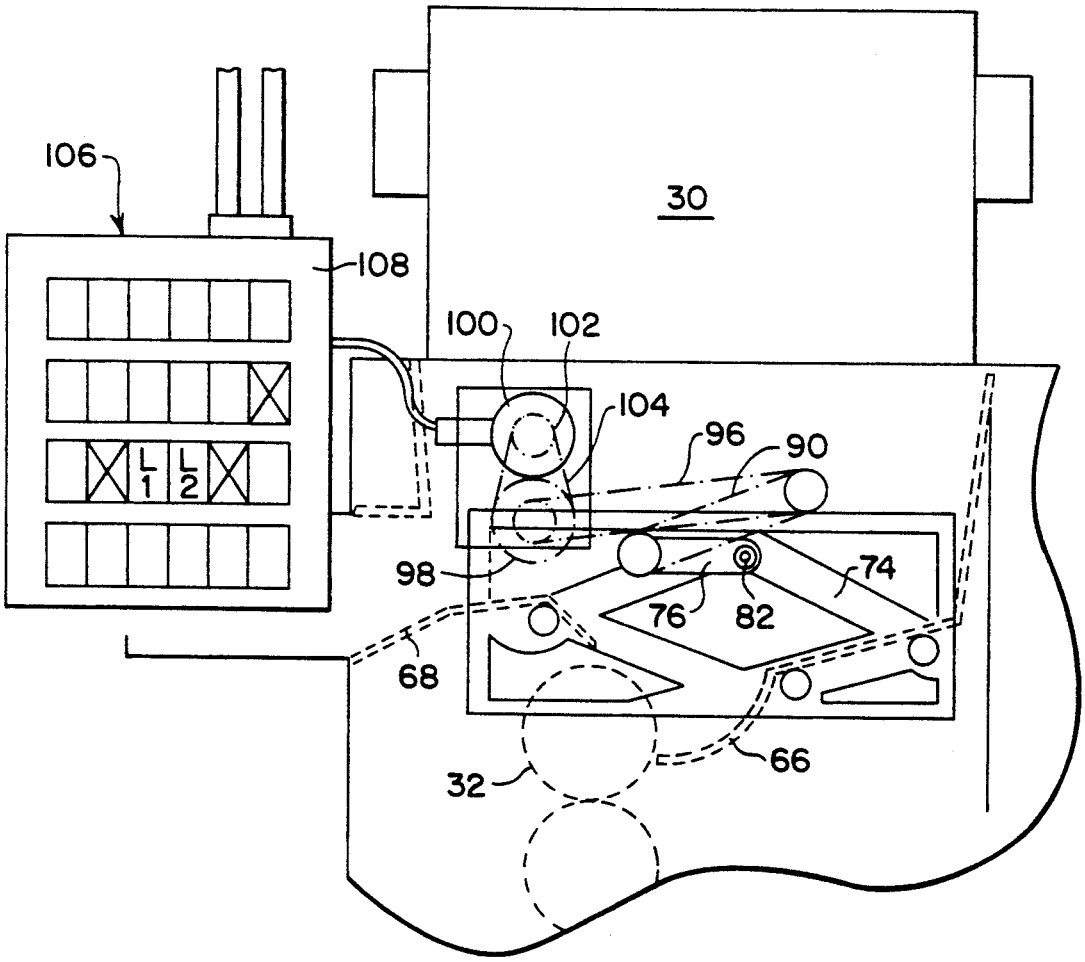
FIG. 5 is an elevated side view showing the control panel linking the receiver motors with the vibratory drive motor of the present invention.

With reference to FIG. 5, the vibratory motor 100 is connected to the control relay panel 106 through a twin line plug receiver panel 108. The control relay is connected to each of the pneumatic plug motors 19 and 21 for receivers 18 and 20 respectively. The control relay panel 106 may be set so that the vibratory motor 100 is turned on whenever the motors 19 and 21 for the receivers 18 and 20 are turned on. The control relay panel 106 may also be set so that the activation of the vibratory motor 100 is delayed for thirty seconds after the motors for receivers 18 and 20 have stopped running.

Although the invention has been described in detail with reference to a specific preferred embodiment, various modification exist within the scope and spirit of the present invention and it is not intended that the aforementioned discussion in any way limits the scope of the present invention as set forth in the following claims appended hereto.

What is claimed is:

1. An apparatus for agitating cigarette filters in a filter hopper comprising:
   - a filter hopper having a feed inlet and a feed outlet;
   - means to feed filters to said feed inlet;
   - means to discharge filters through said feed outlet;
   - means to agitate said feed hopper in response to said means to feed filters to said hopper;
   - said means to agitate including a drive means in driving relation with a cam mechanism; and
   - said drive means including a drive motor having an outwardly extending shaft with a pulley thereon, a speed reducer with outwardly extending shafts at opposite ends thereof, a first belt extending between said drive motor and one shaft of said speed reducer, and a second belt extending between an opposite shaft of said speed reducer and said cam mechanism.

2. The apparatus of claim 1 wherein said means to agitate is operable in agitating mode when said means to feed filters is in a filter feeding mode.

3. The apparatus of claim 1, said cam mechanism comprising a pulley including an outwardly extending eccentric pin attached a preselected distance from the center of said pulley.

4. The apparatus of claim 1, said drive means further including a second variable speed reducer with at least one outwardly extending shaft having a first and second pulley thereon, said second variable speed reducer being mounted in cooperative relationship between said motor and said first speed reducer, said first pulley of said second speed reducer being connected by a belt to said motor and said second pulley of said second speed reducer being connected to said first speed reducer.

5. The apparatus of claim 1, said means to feed filters to said feed inlet including at least one receiver in flow communication with a pneumatic conveying system.

6. The apparatus of claim 1, said means to discharge filters through said feed outlet including at least one vibratory plate in contact with said filters, said vibratory plate oscillating in response to said means to feed filters 7. An apparatus for agitating cigarette filters in a filter hopper comprising:

a filter hopper having a feed inlet and a feed outlet;

means to feed filters to said feed inlet;

means to discharge filters through said feed outlet;

means to agitate said feed hopper in response to said means to feed filters to said hopper;

said means to agitate comprising a first vibratory baffle plate and a second vibratory baffle plate defining generally flat strips of material extending downwardly at an angle from the top of opposite sides of said hopper toward the center of said hopper, said distal end of said first baffle plate being positioned slightly below the centerline, adjacent to, and spaced from a grooved filter receiving roll a distance less than the width of a filter, said second vibratory baffle plate having a distal end being positioned slightly above the centerline, adjacent to, and spaced from said grooved filter receiving roll a distance less than the width of a filter, said first vibratory baffle and said second vibratory baffle plate being removably mounted to a vibratory frame movably secured within said hopper with a means of attachment, said vibratory frame oscillating said first and second vibratory baffle plates agitating said filters.

* * * * *